US008555513B2

(12) United States Patent
Moreland et al.

(10) Patent No.: US 8,555,513 B2
(45) Date of Patent: Oct. 15, 2013

(54) HAND HELD ROTARY CUTTING DEVICES

(75) Inventors: Jessica A. Moreland, Columbus, OH (US); Christopher L. Hawker, Columbus, OH (US)

(73) Assignee: Trident Design, LLC, Columbus, OH (US)

( * ) Notice: Subject to any disclaimer, the term of this patent is extended or adjusted under 35 U.S.C. 154(b) by 811 days.

(21) Appl. No.: 12/660,875

(22) Filed: Mar. 5, 2010

(65) Prior Publication Data

US 2011/0099818 A1 May 5, 2011

Related U.S. Application Data

(60) Provisional application No. 61/280,344, filed on Nov. 2, 2009.

(51) Int. Cl.
*B26B 3/00* (2006.01)

(52) U.S. Cl.
USPC ..... 30/292; 30/306; 30/307; 30/316; 30/319

(58) Field of Classification Search
USPC ..... 30/292, 306, 307, 319, 294, 315, 316, 30/329–331, 339
See application file for complete search history.

(56) References Cited

U.S. PATENT DOCUMENTS

| | | | | |
|---|---|---|---|---|
| 54,223 A | | 4/1866 | Shepard | 30/307 |
| 209,065 A | | 10/1878 | Millspaugh | 30/319 |
| 252,268 A | | 1/1882 | Silcott | 83/490 |
| 609,213 A | | 8/1898 | Ridgely | 30/292 |
| 733,511 A | | 7/1903 | Ridgely | 30/292 |
| 775,434 A | | 11/1904 | Williams | 30/292 |
| 1,983,778 A | | 12/1934 | Rosenquist | 164/84 |
| 2,255,930 A | * | 9/1941 | Jepson | 30/151 |
| 2,490,255 A | | 12/1949 | Chase | 143/44 |
| D159,723 S | | 8/1950 | Glade | D93/3 |
| 2,526,154 A | | 10/1950 | Parks | 17/29 |
| 2,644,230 A | * | 7/1953 | Anderson | 30/151 |
| 3,590,483 A | * | 7/1971 | Szczepanski | 30/31 |
| 3,621,894 A | | 11/1971 | Niksich | 143/21 |
| 3,644,994 A | * | 2/1972 | Lind | 30/292 |
| 4,020,550 A | | 5/1977 | Okada | 30/124 |
| 4,432,137 A | | 2/1984 | Okada | 30/292 |
| 4,738,028 A | | 4/1988 | Belokin et al. | 30/319 |
| 5,101,564 A | | 4/1992 | Melter | 30/319 |
| D330,665 S | | 11/1992 | Neuendorf | D7/693 |

(Continued)

FOREIGN PATENT DOCUMENTS

BE 1013992 A6 * 1/2003

*Primary Examiner* — Jason Daniel Prone
(74) *Attorney, Agent, or Firm* — David A. Burge

(57) ABSTRACT

A hand held rotary cutting device having an annular cutting blade with an interior diameter entirely protectively enclosed by a housing, and with a sharpened periphery partially protectively enclosed by the housing, wherein the housing has similarly configured front and rear components that are movable between an open position that permits removal of the cutting blade for cleaning, and a closed position wherein the front and rear components cooperate to rotatably support the cutting blade, and to define an elongate handle that overlies a housed portion of the cutting blade. Cutting pressure, stability and unusually effective guidance are supplied to the cutting blade by novel C-shaped lower portions of the front and rear components of the housing that extend continuously along opposite sides of the cutting blade just above and quite near to where selected portions of a long, exposed C-shaped reach of the sharpened periphery of the cutting blade is available to sever thin food such as pizza.

36 Claims, 13 Drawing Sheets

(56) References Cited

U.S. PATENT DOCUMENTS

| | | | | | |
|---|---|---|---|---|---|
| 5,220,729 | A | * | 6/1993 | Gallant | 30/380 |
| 5,299,355 | A | * | 4/1994 | Boda et al. | 30/162 |
| D352,426 | S | | 11/1994 | Tucker | D7/696 |
| 5,369,886 | A | | 12/1994 | Gallatin | 30/371 |
| D355,815 | S | | 2/1995 | La Gro | D7/694 |
| 5,428,898 | A | | 7/1995 | Hawkins | 30/295 |
| 5,504,998 | A | | 4/1996 | Nguyen | 30/319 |
| D375,662 | S | * | 11/1996 | Noga | D7/694 |
| 5,711,077 | A | | 1/1998 | Schulz et al. | 30/160 |
| D397,001 | S | | 8/1998 | Antista et al. | D7/694 |
| 6,094,824 | A | | 8/2000 | Takeshita | 30/276 |
| D460,338 | S | | 7/2002 | Martelli | D8/98 |
| 6,438,850 | B2 | * | 8/2002 | Young et al. | 30/162 |
| 6,643,936 | B2 | * | 11/2003 | Carlson et al. | 30/162 |
| D494,823 | S | * | 8/2004 | Overthun et al. | D8/20 |
| D509,710 | S | * | 9/2005 | Lee | D7/694 |
| 6,938,348 | B2 | * | 9/2005 | Roncaglia | 30/276 |
| D519,334 | S | | 4/2006 | Molenaar | D7/694 |
| 7,134,209 | B1 | * | 11/2006 | Molenaar | 30/319 |
| 7,188,424 | B2 | * | 3/2007 | Webster et al. | 30/365 |
| 7,363,710 | B2 | | 4/2008 | Kortleven et al. | 30/143 |
| D594,292 | S | | 6/2009 | Eide et al. | D7/694 |
| 7,823,292 | B1 | * | 11/2010 | Castiglione et al. | 30/306 |
| D639,619 | S | | 6/2011 | Waege | D7/694 |
| D642,879 | S | * | 8/2011 | Chan | D7/694 |
| 8,011,103 | B2 | | 9/2011 | Blum | 30/299 |
| D652,271 | S | | 1/2012 | Moore et al. | D7/694 |
| D661,555 | S | * | 6/2012 | Holcomb et al. | D7/694 |
| 2004/0049924 | A1 | | 3/2004 | Robinowitz et al. | 30/307 |
| 2004/0231475 | A1 | * | 11/2004 | Cornfield et al. | 83/13 |
| 2005/0028388 | A1 | * | 2/2005 | Liu | 30/319 |
| 2007/0028463 | A1 | * | 2/2007 | Chan | 30/319 |
| 2010/0037787 | A1 | * | 2/2010 | Eide et al. | 99/538 |
| 2010/0319513 | A1 | * | 12/2010 | Hsu | 30/316 |

* cited by examiner

HAND HELD ROTARY CUTTING DEVICES

REFERENCE TO PROVISIONAL APPLICATION

This application claims the benefit of U.S. Provisional Application Ser. No. 61/280,344 entitled ROTARY CUTTING DEVICE filed Nov. 2, 2009 by Jessica A. Moreland and Christopher L. Hawker, the disclosure of which is incorporated herein by reference.

BACKGROUND

The present invention relates to a hand held rotary cutting device and, more particularly, to a rotary cutting device for relatively thin food such as pizza.

It is well known to use rotary cutting devices having cutting wheels with sharpened peripheries to cut and slice relatively thin foods such as pizza. The cutting wheel is pressed downwardly through the food as the cutting device is guided to roll the wheel along selected paths of travel where cuts are to be made.

A drawback common to many known and proposed rotary cutting devices is that their components are configured in ways that not only permit but also encourage portions of food being cut to adhere to the cutting wheels, and to be carried into interior regions of components that surround, support and/or house portions of the cutting wheels—which can quickly cause a deterioration of the cutting action of the cutting wheels as they become progressively more difficult to turn, leaving ragged and uneven cuts in place of the clean, straight-line cuts that are desired.

Some known and proposed rotary cutting devices have recognized the advantages that are attainable by utilizing annular cutting blades instead of disk-shaped cutting blades. For example, the use of an annular cutting blade that has a sizable open center region permits the use of a compact form of housing that also has a sizable open center region, through which the fingers of a user's hand can extend to grasp a handle portion of the housing to provide cutting pressure and guidance to the rotary cutting device. However, a significant drawback of known and proposed rotary cutting devices that employ annular cutting blades is a failure resulting from the design of their housings to supply stability, cutting pressure and guidance to their annular cutting blades at locations extending along opposite sides of the cutting blades just above and quite near to where sharpened peripheral portions of the cutting blades are brought into engagement with and used to sever thin foods such as pizza.

Moreover, many known and proposed rotary cutting appliances fail to provide easy to open, easy to separate, and easy to disassemble components that facilitate the removal of collected and adhered food particles that may need to be removed during use, or that must be removed when the utensil is ready to be cleaned for storage and/or reuse. Some known and proposed rotary cutting utensils include a sizable number of components that, when disassembled for cleaning, leave the user with an erector set collection of parts to reassemble before the cutter can be returned to service.

Another common drawback of known and proposed rotary cutting devices is that the handles or housings that support their rotary cutting wheels are not well suited, ergonomically, to facilitate their being easily grasped by one's hand during use when downwardly directed cutting pressure needs to be applied to the food being cut, while also permitting the easy grasp of one's hand to guide the rotary cutting wheel along desired paths of travel where the food is to be severed.

These and other drawbacks of the prior art are addressed by rotary cutting devices of the present invention that are easy to grip, easy to use, and easy to clean.

SUMMARY

In some embodiments of the present invention, hand held rotary cutting devices each include an annular cutting blade that has an internal diameter entirely protectively enclosed by a housing, and a sharpened periphery that is partially protectively enclosed by the housing, leaving a lengthy C-shaped reach of the sharpened periphery exposed for engaging and severing thin foods such as pizza. The housing 1) includes front and rear components that are movable between a closed position wherein the housing rotatably supports the cutting blade, and an open position that permits removal of the cutting blade for cleaning, and 2) provides a capability to releasably retain the front and rear components in the closed position. When the front and rear components are in the closed position, they cooperate to provide C-shaped lower portions that extend continuously along opposite sides of the cutting blade just above and quite near to where selected portions of the lengthy C-shaped reach of the sharpened periphery of the cutting blade may be used to sever thin food such as pizza.

In some embodiments, rotary cutting devices each have an annular cutting blade with a sharpened periphery partially protectively enclosed by a housing formed from similarly configured, pivotally connected, front and rear components that are movable between open and closed positions. When the housing components are in the closed position, they cooperate to rotatably support the cutting blade, to define an elongate handle of bulbous shaped cross-section overlying a fully housed portion of the cutting blade, and to provide a latch that is adapted to releasably retain the front and rear housing components in the closed position. In some of these embodiments, the front and rear components cooperate, when in the closed position, to provide C-shaped lower portions that extend continuously along opposite side locations of the cutting blade just above and quite near to where selected portions of a lengthy C-shaped reach of the sharpened periphery of the cutting blade may be used to sever thin food such as pizza to engage, guide and provide stability to the cutting blade by engaging the blade at the opposite side locations.

In some embodiments, rotary cutting devices each have an annular housing that protectively overlies the full length of an internal diameter of an annular cutting blade having a sharpened periphery that is protectively shielded along at least about a 150 degree portion of its periphery by front and rear portions of the housing that are pivotally connected to move between an open position that permits the annular cutting blade to be removed for cleaning, and a closed position wherein the front and rear portions of the housing cooperate to define an elongate handle of bulbous cross-section that overlies a majority of the shielded reach of the sharpened periphery of the cutting blade. The housing also carries a latch adapted to releasably retain the front and rear portions of the housing in the closed position.

In some embodiments, hand held rotary cutting devices each include a housing having substantially identically shaped, pivotally connected, front and rear components that are movable between an open position that permits removal from the housing of an annular shaped cutting blade, and a closed position wherein the front and rear components cooperate 1) to rotatably support the annular shaped cutting blade, 2) to protectively shield an entire internal diameter portion of the annular shaped cutting blade, 3) to protectively shield at least about a 150 degree reach of a sharpened periphery of the annular cutting blade leaving an exposed, lengthy, C-shaped reach of at least about 200 degrees of the sharpened periphery of the annular cutting blade for engaging and severing thin food such as pizza, and 4) to provide C-shaped lower portions that extend continuously along opposite sides of the cutting blade just above and quite near to where selected portions of the lengthy C-shaped reach of the sharpened periphery of the cutting blade may be used to sever thin food such as pizza.

In some of the above-described embodiments, the front and rear housing components also cooperate, when in the closed position, to define a substantially D-shaped central opening situated inside the internal diameter of the annular cutting blade. The D-shaped opening may occupy a majority of an area circumscribed by the internal diameter of the annular cutting blade, and the elongate handle may extend along a substantially straight portion of a border of the D-shaped opening.

In some of the above-described embodiments, the elongate handle may extend along at least about a 90 degree angular reach of the cutting blade, and the housing may protectively enclose at least about a 150 degree angular reach of the sharpened periphery of the cutting blade. Moreover, the front and rear portions of the housing may cooperate to define thumbguard formations located near opposite end regions of the elongate handle.

In some of the above-described embodiments, the cutting blade's interior diameter region is protectively enclosed by a continuous blade guard of generally U-shaped cross-section; and the housing may provide at least one curved formation that extends along the blade guard to guide the cutting blade during its rotation relative to the housing.

In some of the above-described embodiments, a bulbous cross-section of the elongate handle preferably has its maximum cross-sectional area at a midway location along the handle's length, and the cross-sectional area diminishes in a progressive manner at locations spaced progressively farther from the midway location. If, for example, the bulbous cross-section exhibited by a particular handle is an oval cross-section, the oval is preferably of its largest cross-sectional area at a mid-way location along the handle's length, and at locations that are spaced progressively farther from the mid-way location, the handle exhibits progressively smaller cross-sectional areas. However, as the size of the handle diminishes at locations spaced progressively farther from the mid-way location (in each of two opposite directions), the shape of the oval (i.e., its length to width proportions) remain the same, so the appearance of each oval cross-section always yields the same shape—and, at locations spaded equidistantly along opposite ends of the handle from the mid-way location, the oval cross-sections exhibited are of identical size and shape.

BRIEF DESCRIPTION OF THE DRAWINGS

These and other features, and a fuller understanding of the invention may be had by referring to the following description and claims, taken in conjunction with the accompanying drawings, wherein:

DETAILED DESCRIPTION

Figure 1:
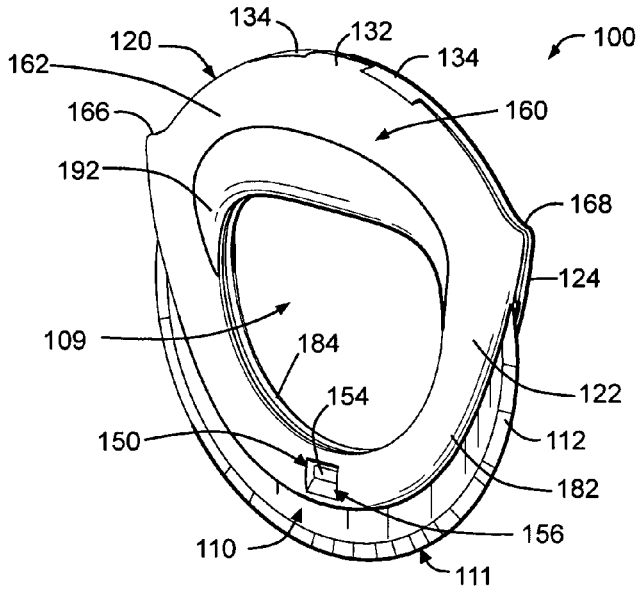
FIG. 1 is a perspective view of a rotary cutting device, with the view showing principally front and right side features thereof.
Figure 2:
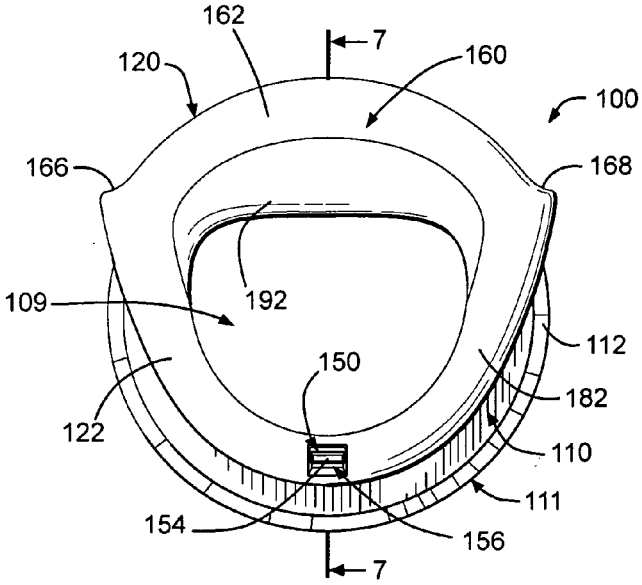
FIG. 2 is a front view thereof.
Figure 3:
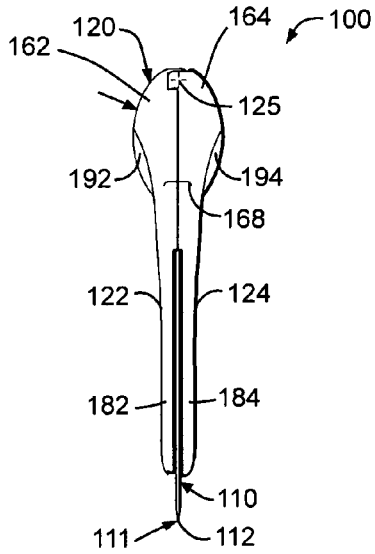
FIG. 3 is a right side view thereof.
Figure 4:
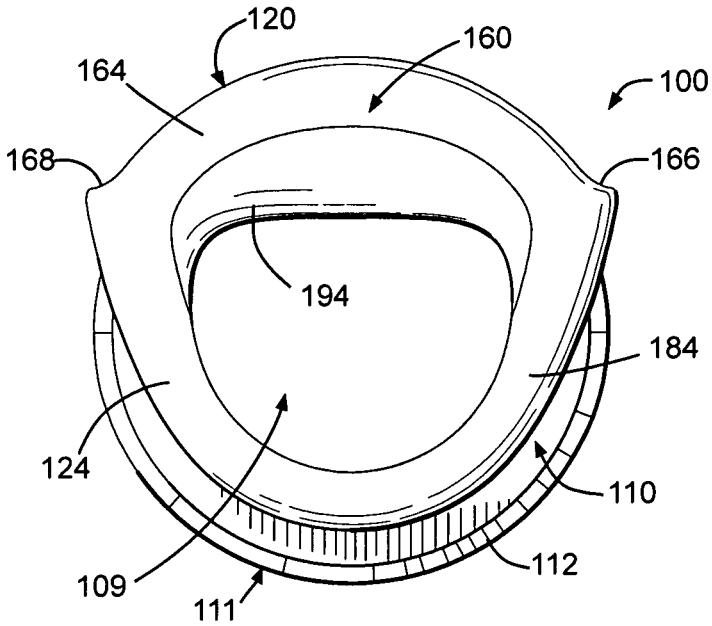
FIG. 4 is a rear view thereof.
Figure 5:
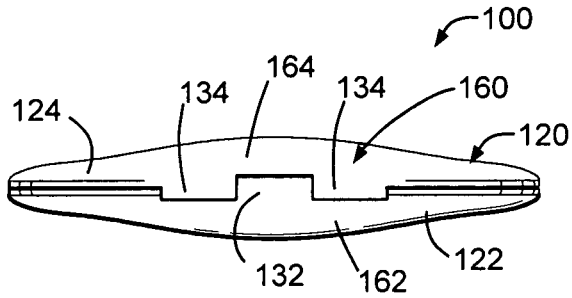
FIG. 5 is a top view thereof.
Figure 6:
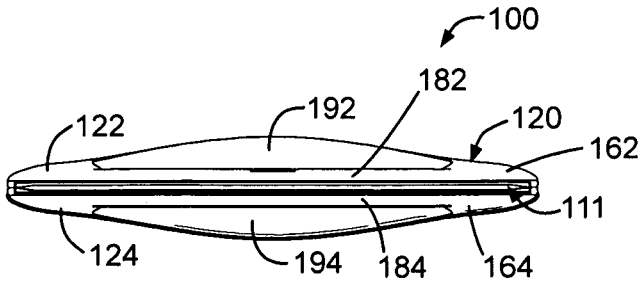
FIG. 6 is a bottom view thereof.

Referring to FIGS. 1-3, a rotary cutting device embodying features of the present invention is indicated generally by the numeral 100. The rotary cutting device 100 has an annular cutting blade 110 that is rotatably supported by a housing 120.

As will be explained, the housing 120 is mainly defined by a pair of very similarly configured front and rear components 122, 124 that are pivotally connected to enable them to pivot between an open position shown in FIGS. 9 and 10, and a closed position shown in FIGS. 1-8. When the front and rear housing components 122, 124 are in the closed position, they define front and rear components 162, 164, respectively, of an elongate handle 160 that extends along an upper portion of the housing 120 which protectively encloses a length of the sharpened periphery of the annular cutting blade 110 that forms a sharpened cutting edge 112 of the blade 110.

Figure 7:
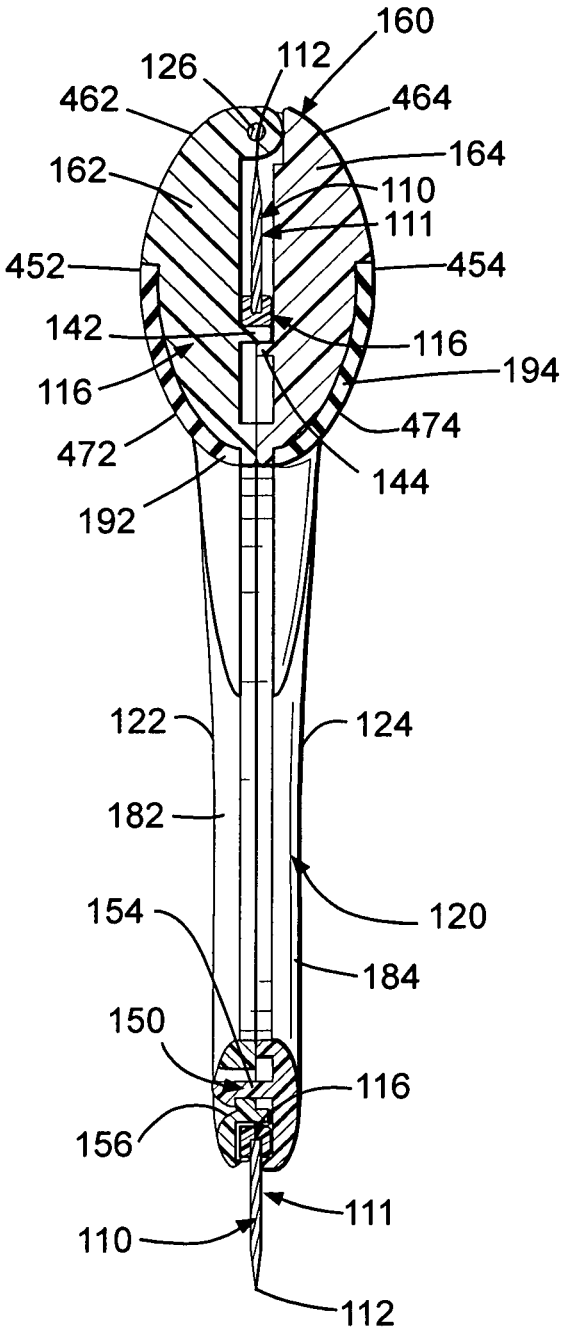
FIG. 7 is a cross-sectional view, on an enlarged scale, as seen from a plane indicated by a line 7-7 in FIG. 2.
Figure 16:
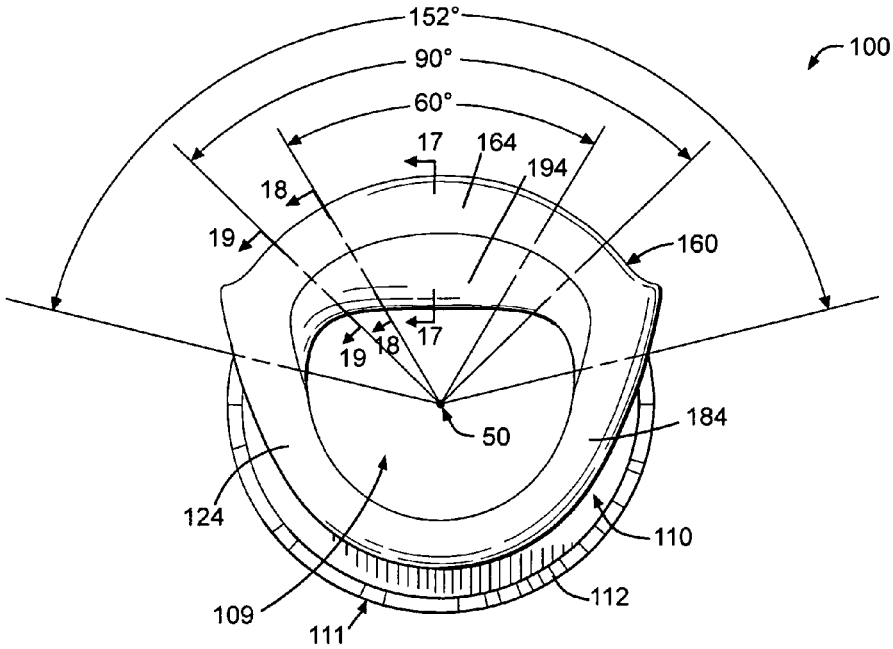
FIG. 16 is a rear view of the rotary cutting device on an enlarged scale with angular dimensions added.
Figure 17:
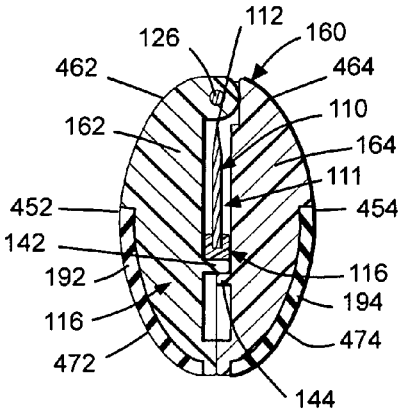
FIGS. 17, 18 and 19 are cross-sectional views as seen from planes indicated by lines 17-17, 18-18 and 19-19, respectively, in FIG. 16.
Figure 18:
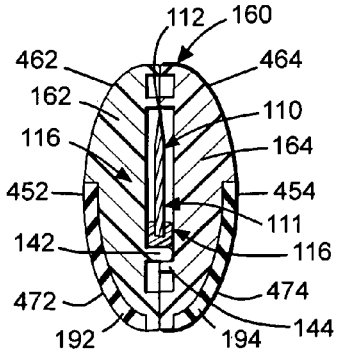
Figure 19:
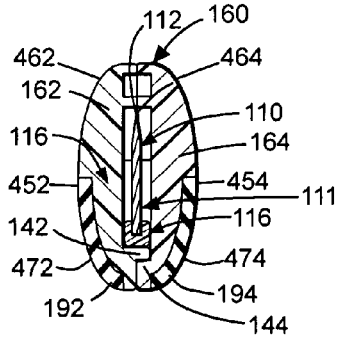

Actually, as can best be seen in FIGS. 7 and 17-19, the cross-section of the handle 160 is not only defined by the front and rear components 162, 164, but also by relatively small, thin, front and rear components 192, 194 that preferably are formed from a softer, more resilient material than the material that forms the thicker, more sizable front and rear components 162, 164. The small, thin front and rear components 192, 194 are installed in carved out regions of the front and rear components 162, 164, and cooperate with the front and rear components 162, 164 to give the handle 160 a bulbous cross-section (an oval cross-section as depicted in FIGS. 7 and 17) that is of maximum size (maximum cross-sectional area) at a center or mid-point location along the length of the handle 160 (as shown by the cross-sectional views of FIGS. 7 and 17), and diminishes in size (i.e., in cross-sectional area) at locations spaced progressively farther from the center of the mid-point location, for example at the locations shown in FIG. 16 where the cross-sections shown in FIGS. 18 and 19 are taken.

At locations spaced equidistantly from the center or mid-point location (where the cross-sections of FIGS. 7 and 17 are taken) the cross-sections are identical—which is to say that the oval cross-sections depicted in FIGS. 18 and 19 taken from the left side of where the cross-sections of FIGS. 7 and 17 are taken, are identical to the oval cross-sections one would find at locations spaced the same distances to the right of where the cross-sections of FIGS. 7 and 17 are taken.

As can be seen in FIGS. 7 and 17, at a location mid-way along the length of the handle 160, the front and rear components 162, 164, 192, 194 of the handle 160 cooperate to give the handle 160 a relatively wide, bulbous, oval shaped cross-section that is well suited to be grasped in order to depress the rotary cutting device 100 through food to be cut, and to guide the cutting blade 110 along desired paths of travel along which food is to be severed. As can be seen in FIGS. 18 and 19, at locations approaching opposite end regions of the elongate handle 160, the front and rear components 162, 164, 192, 194 cooperate to give the handle 160 a progressively more narrow, somewhat less bulbous, oval shaped cross-section, with the oval shapes found in all of these cross-sections preserving the same height to width ratio, so that the oval cross-sections are of identical shape, and merely differ in size.

What is meant herein by use of the term "bulbous" in referring to various cross-sections that may be exhibited by the handle 160 (such as are illustrated by a primary embodiment shown in of FIGS. 7 and 17-19, and by alternate embodiments that are shown in FIGS. 21-24) are handle cross-sections that are wider at their mid-height locations (indicated by the numerals 452, 454 in FIGS. 7, 17-19 and 21-24) than at their top and bottom locations (indicated by the numerals 462, 464 and 472, 474 in FIGS. 7, 17-19 and 21-24, respectively). Whereas most previously proposed housing-defined handles of rotary cutting devices that employed annular cutting blades have provided opposite side surfaces that are flat and parallel to each other, annular cutting devices that embody features of the present invention may, and preferably do, provide handle cross-sections with opposite side surfaces that bulge outwardly away from each other (in any of a variety of ways such as are illustrated by the example cross-sections shown in FIGS. 17 and 21-24), with their outwardly bulging characteristics providing ergonomic configurations that enable users of the rotary cutting devices 100 to easily and comfortably grasp the handles 160 as they employ the cutting devices 100 sever thin foods such as the pizza 500 shown in FIGS. 20 and 25 along desired paths of travel such as are designated by the numerals 502.

Figure 9:
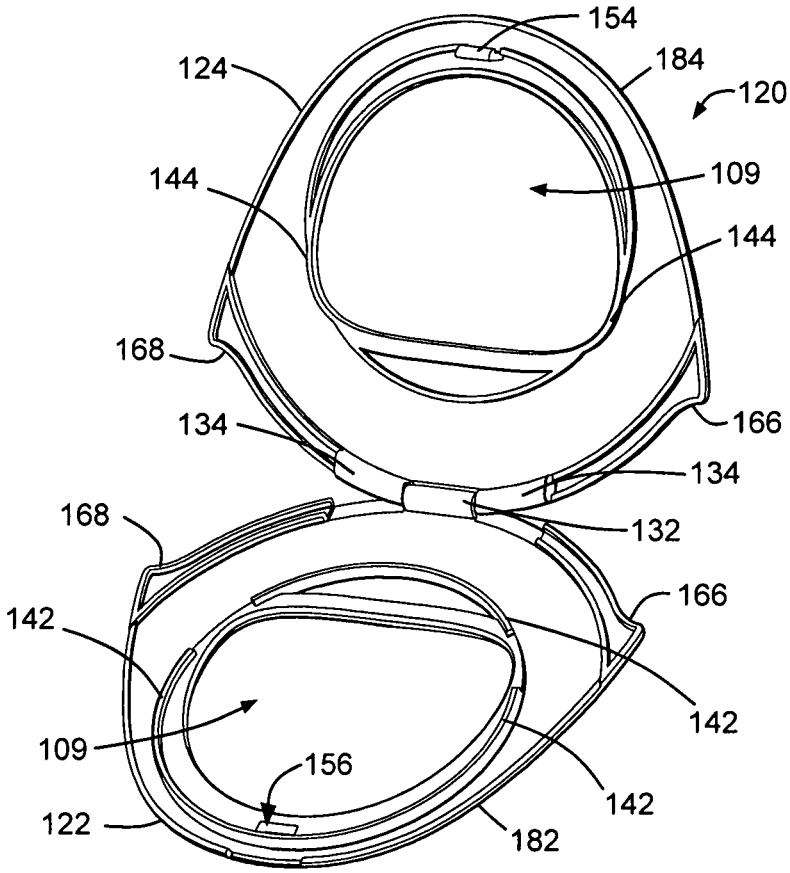
FIG. 9 is a perspective view of the housing with components thereof pivoted to an open position.
Figure 10:
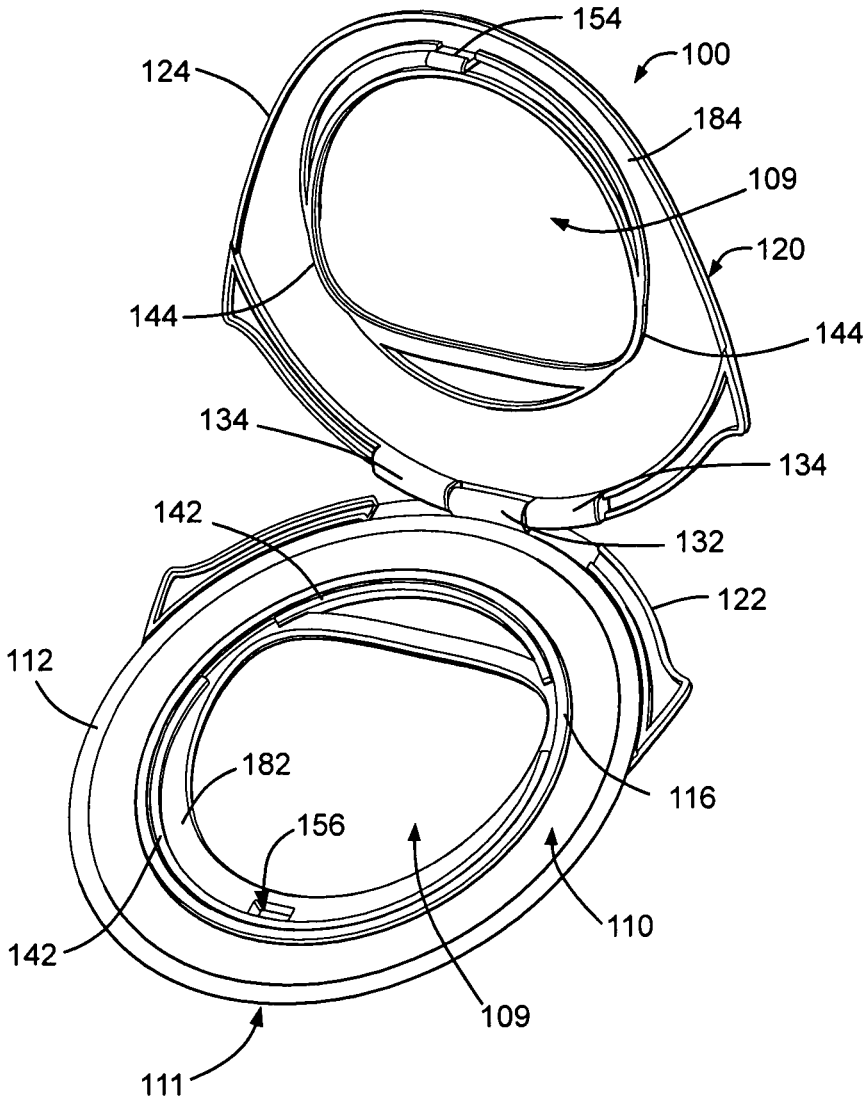
FIG. 10 is a perspective view of the rotary cutting device with components of the housing pivoted to the open position.
Figure 11:
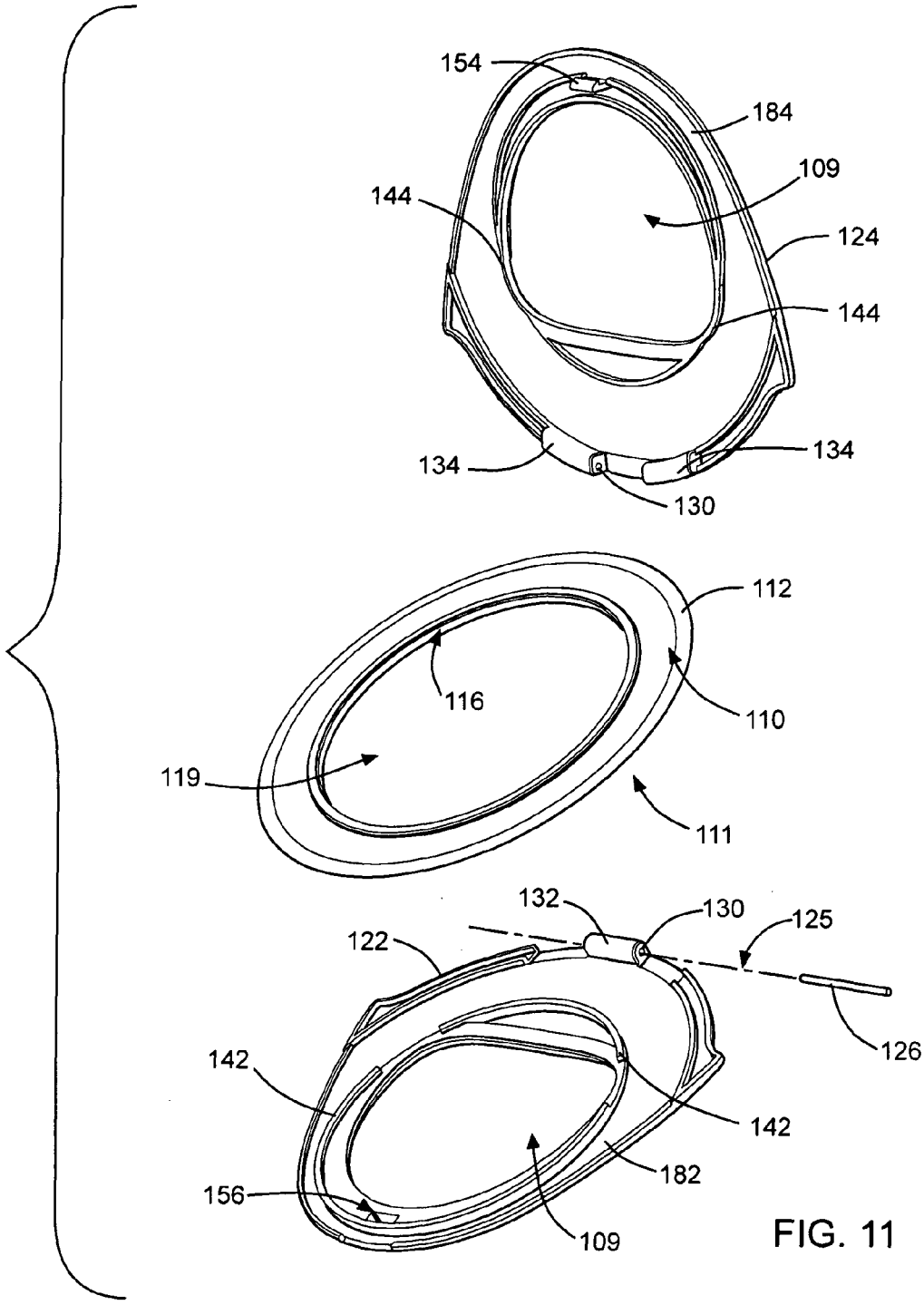
FIG. 11 is an exploded view of components of the rotary cutting device.

Referring to FIGS. 9-11, the housing's front and rear components 122, 124 have front and rear C-shaped lower portions 182, 184 that depend from opposite end regions of the front and rear components 162, 164, respectively, of the handle 160. The front and rear C-shaped lower portions 182, 184 cooperate with the front and rear components 162, 164 to define a sizable opening 109 that is substantially D-shaped which occupies the majority of an open area of the annular cutting blade assembly 111, which is indicated by the numeral 119 in FIGS. 11 and 12.

Figure 12:
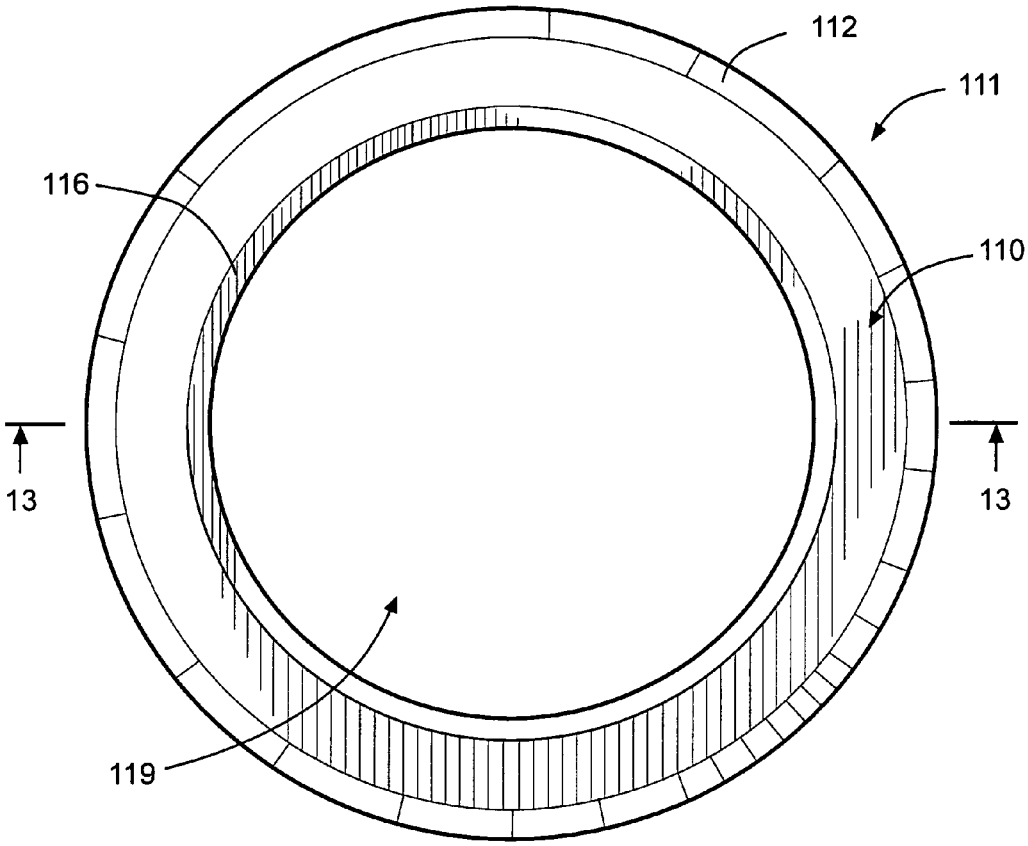
FIG. 12 is a front view, on an enlarged scale, of an annular cutting blade component of the rotary cutting device.
Figure 13:
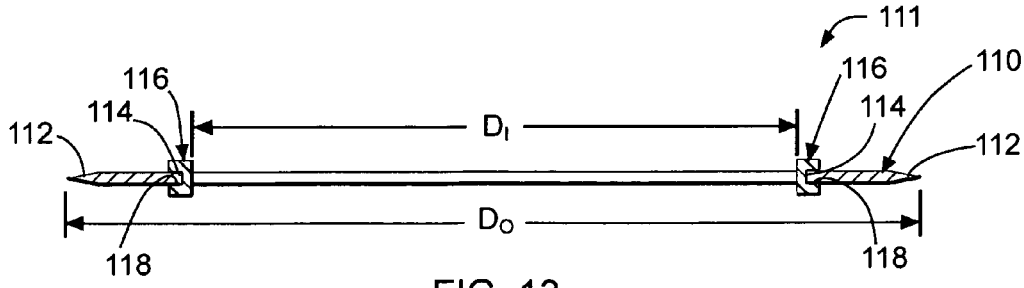
FIG. 13 is a cross-sectional view as seen from a plane indicated by a line 13-13 in FIG. 12.

Referring to FIGS. 11-13, the annular cutting blade 110 is a substantially flat member preferably formed from stainless steel, which has a tapered periphery that defines the relatively sharp cutting blade edge 112. An inner diameter 114 of the steel cutting blade 110 is protectively enclosed by an annular guard element 116 which has a substantially U-shaped cross-section. A radially outwardly opening groove 118 (see FIG. 13) defined by the U-shaped cross-section of the annular guard element 116 snugly receives the inner diameter 114 of the annular cutting blade 110. The annular guard element 116 is preferably permanently affixed to the annular cutting blade 110 in a manner that prevents food particles from entering and accumulating within the groove 118.

The steel cutting blade 110 and the guard element 116 cooperate to form a cutting blade assembly 111 that has an inner diameter $D_I$ and an outer diameter $D_O$, the dimensions of which are labeled in FIG. 13. The open area 119 of the cutting blade assembly 111 that is bounded by the inner diameter $D_I$ is sizable, and a majority of it (i.e., actually about ⅔ of the open area 119) is occupied by the open area bounded by the D-shaped opening 109 of the housing 120 shown in FIGS. 1, 2, 4 and 8-11.

Although the steel cutting blade 110 can be made in a wide variety of sizes, for a hand held rotary cutting device 100 intended for use with thin food such as pizza, a preferred outer diameter $D_O$ is about 5.25 inches, and a preferred inner diameter $D_I$ is about 3.75 inches. The 5.25 inch size of the steel cutting blade 110 provides a relatively large blade for cutting thin food such as pizza—and this relatively large size helps to ensure that the blade 110 retains its planar (flat) configuration, and provides a blade 110 that the housing 120 can securely guide and hold on a desired travel path, such as is indicated by the cut line 502 in FIGS. 20 and 25 where the cutter 100 is shown cutting a pizza 500.

Although the cutting edge 112 of the steel cutting blade 110 is shown as being smooth and uninterrupted along its length, other types of cutting blades (not shown) that feature other types of cutting edges, such as a serrated edge (not shown), can be substituted for the cutting blade 110, as will be readily understood by those who are skilled in the art. Indeed, a feature of the hand held rotary cutter 100 is the ease with which the cutting blade assembly 111 can be removed from the housing 120 for cleaning and/or replacement, when the front and rear housing components 122, 124 are pivoted to their open position, as depicted in FIGS. 9 and 10. In FIG. 9 the cutting blade assembly ill has been removed from the depicted open housing 120. In FIG. 10, the cutting blade assembly 111 remains in place in the open housing 120.

Figure 8:
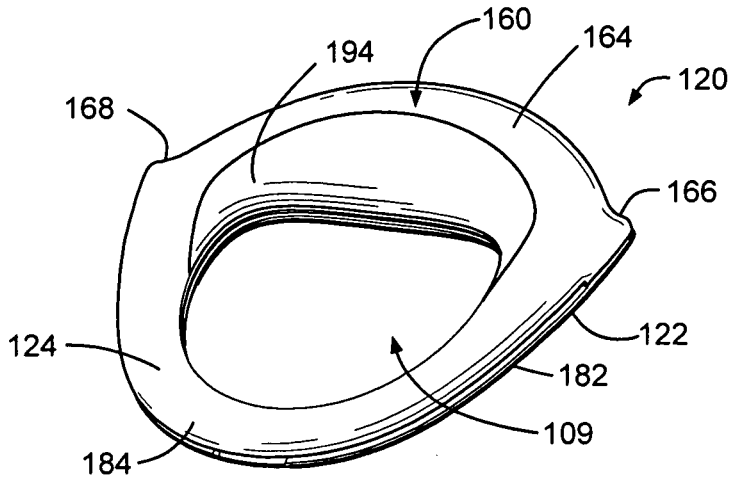
FIG. 8 is a perspective view of the housing of the rotary cutting device, with components of the housing in a closed position.

Referring to FIGS. 8-10, the front and rear housing components 122, 124 are pivotally connected for movement between the closed position shown in FIGS. 1-8 and the open position shown in FIGS. 9-10 by a pivot pin 126 (shown in FIG. 11) that extends along an axis 125 through alignable holes 130 defined by alignable hinge formations 132, 134 of the front and rear housing components 122, 124, respectively. When the pivot pin 126 is inserted into the aligned holes 130 of the formations 132, 134, a pivotal connection is established that permits the front and rear housing components 122, 124 to pivot freely between the open and closed positions of FIGS. 9-10 and 1-8, respectively, when a latch 150 carried by the housing 120 is released, as will be explained shortly.

The interiors of the front and rear housing components 122, 124 are configured to receive the annular cutting blade assembly 111 in a slip fit that permits the annular cutting blade assembly 111 to turn smoothly and freely within the housing 120 when the front and rear components 122, 124 of the housing 120 are in the closed position shown in FIGS. 1-8. Raised, curved formations 142, 144 (see FIGS. 9 and 10) are defined by the front housing component 122 to extend along the interior of, and to engage, the guard element 116 that extends along the interior diameter 114 of the steel cutting blade 110 to guide the annular cutting blade assembly ill as the blade assembly 111 turns relative to the housing 120.

When the annular cutting blade assembly 111 is inserted into the housing 120 to overlie an interior portion of the front housing component 122 (in the manner depicted in FIG. 10), the front and rear housing components 122, 124 may then be pivoted (relative toward each other) to closely overlie each other to close the housing 120. As the housing 120 closes, the housing 120 is caused to protectively enclose a major part of the annular cutting blade assembly 111, preferably including a reach of at least about one hundred fifty degrees, such as the one hundred fifty two degree reach that is designated in FIG. 16.

When the front and rear components 122, 124 of the housing 120 are in the closed position they cooperate to stabilize and support the annular cutting blade assembly 111 for rotation about an imaginary axis indicated by the numeral 50 in FIG. 16. The axis 50 extends through a virtual center of the annular cutting blade assembly 111.

Figure 20:
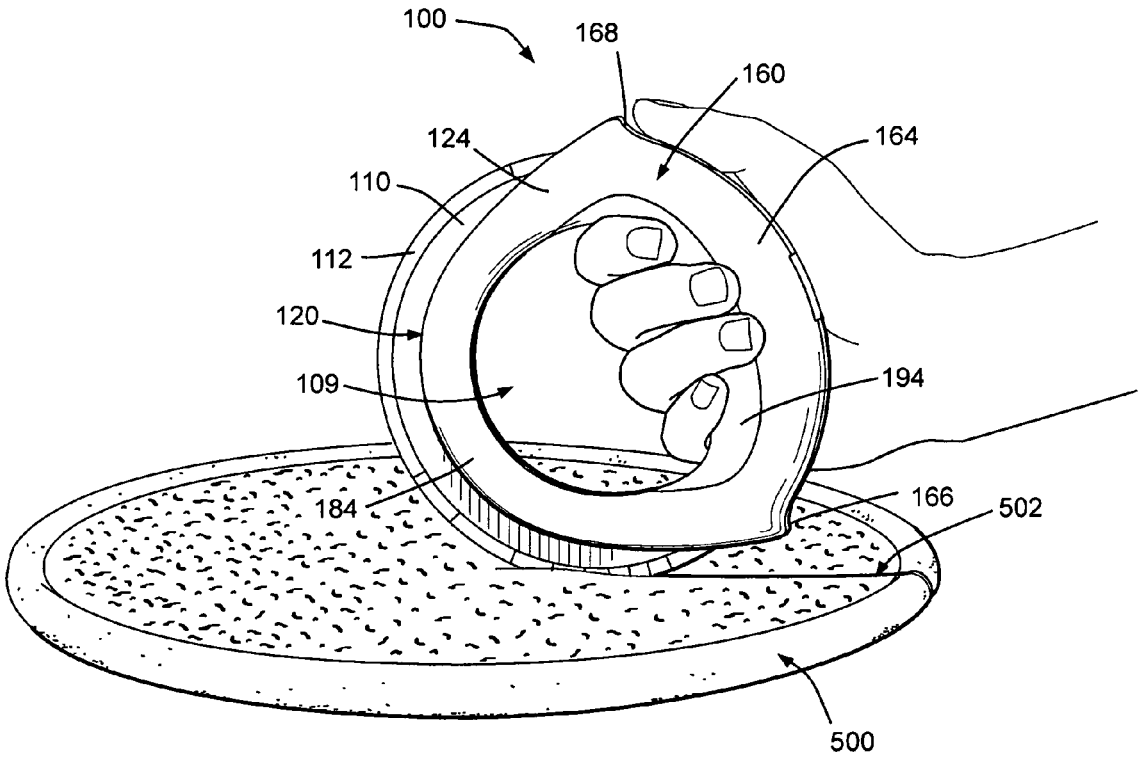
FIG. 20 is a perspective view showing the rotary cutting device being grasped by a hand and used to slice a pizza, with the cutting device tilted to what may be referred to as a "handle low" position.
Figure 25:
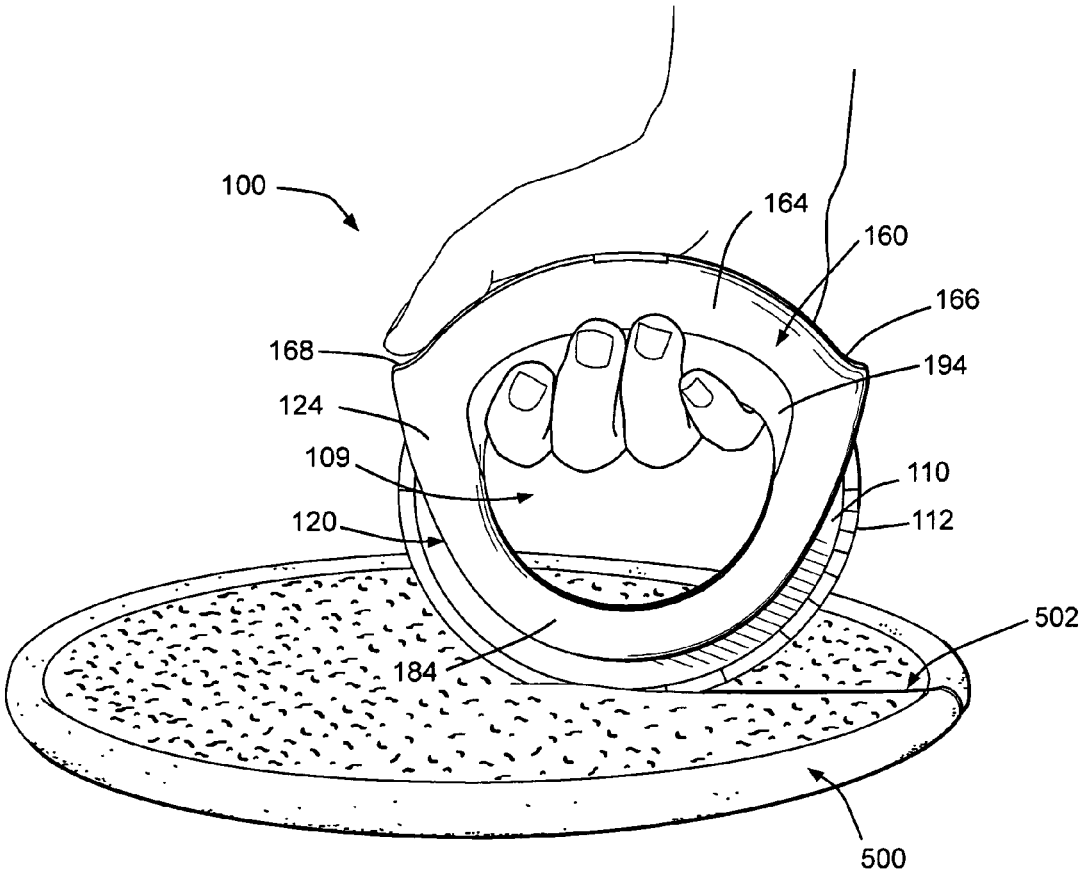

The annular cutting blade 110 has a lengthy C-shaped reach of its sharpened periphery 112 that is exposed and available for use to engage and cut thin foods such as the pizza 500 shown in FIGS. 20 and 25. If the elongate handle 160 encloses at least about a 150 degree reach of the sharpened periphery 112, this leaves a long C-shaped reach of at least about 200 degrees of the sharpened periphery 112 of the cutting blade 110 exposed and available for use to engage and cut thin foods such as the pizza 500. However, the C-shaped lower portions 182, 184 of the front and rear housing components 122, 124 extend along, shroud and engage opposite sides of a C-shaped inner diameter portion of the cutting blade 110 all along and just above the lengthy C-shaped, exposed reach of the sharpened periphery 112 of the cutting blade 110 to provide downward cutting pressure, stability and guidance to the cutting blade 110 just above whatever portion of the exposed C-shaped reach of the sharpened periphery 112 that is brought into engagement with thin food such as the pizza 500 that is to be severed by the cutting blade 110.

The C-shaped lower portions 182, 184 serve to engage, stabilize and guide the cutting blade 110 at locations just above and in close proximity to any part of the sharpened periphery 112 of the cutting blade 110 that may be brought into engagement with food to be cut—and this is true regardless of whether the rotary cutting device 100 is oriented in a "handle high" attitude such as is shown in FIG. 25, or in a "handle low" attitude such as is shown in FIG. 20. The application of cutting force (by the curved formations 142, 144 of the housing 120 that are shown in FIGS. 9-11) to the inner diameter guard 116 (shown in FIGS. 11-13) of the cutting blade assembly 111 at locations just above and quite near to where any selected portion of the sharpened periphery 116 of the cutting blade 110 may be brought into engagement with food to be cut, and the guiding engagement that is applied to opposite sides of the cutting blade assembly 111 at locations just above and quite near to where the sharpened periphery 116 is brought into engagement with food to be cut is unique to rotary cutting devices that embody features of the present invention, and gives these cutting devices 100 a degree of stability and ease of use that is not exhibited by previously proposed rotary cutting devices.

Figure 14:
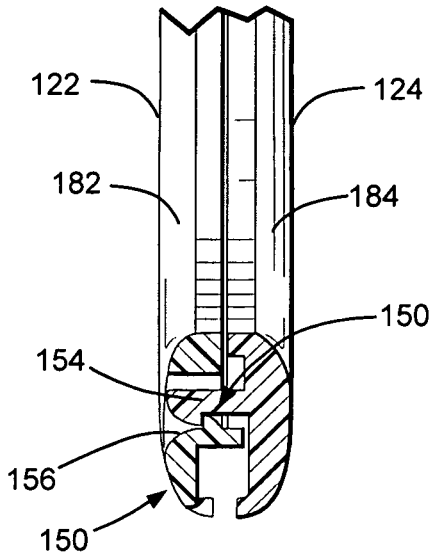
FIG. 14 is an enlargement of a bottom portion of the cross-sectional view of FIG. 7 showing front and rear housing components retained in a closed position by a latch provided on the housing.

To releasably retain the front and rear housing components 122, 124 in the closed position depicted in FIGS. 1-8, the housing 120 is provided with a latch indicated generally by the numeral 150 in FIGS. 1-2. As is best shown in FIGS. 14-15, the latch 150 includes a hook shaped component 154 carried by the C-shaped lower portion 184 of the rear housing component 124 that can snap into engagement with a surface 152 defined by the C-shaped lower portion 182 of the front housing component 122.

Figure 15:
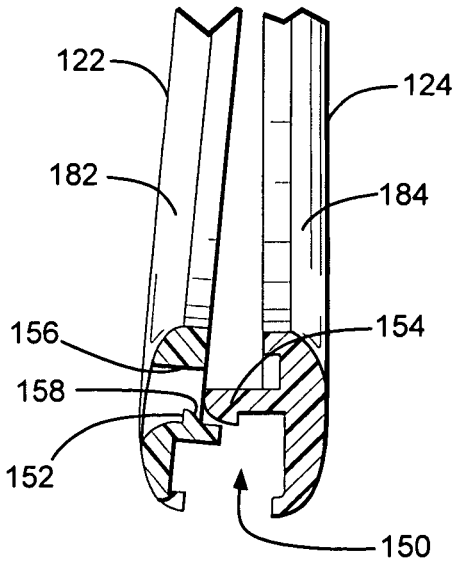
FIG. 15 is a cross-sectional view similar to FIG. 14 but showing the front and rear housing components separated and unlatched.

An opening 156 is formed through the front housing component 122 and is configured to loosely receive the hook-shaped component 154 as the front and rear housing members 122, 124 move toward the closed position and come progressively more closely into overlying relationship, as shown in FIG. 15. As the hook-shaped component 154 enters the opening 156, the hook-shaped component 154 rides upwardly along a ramp 158 defined by the C-shaped lower portion 182 of the front housing component 122. As the front and rear housing components 122, 124 reach the closed position, the hook-shaped component 154 snaps down to engage the surface 152, thereby latching the front and rear components 122, 124 in the closed position, as is depicted in FIG. 14. To release the latch 150 so the housing 120 can be opened, the hook-shaped component 154 can be lifted out of latched engagement with the surface 152 by a fingertip or a thin tool inserted into the opening 156.

Although the accompanying drawings depict one form of a latch 150 that has components formed integrally with the C-shaped lower portions 182, 184 of the front and rear housing components 122, 124, other types of latches (not shown) including many that are commercially available (or that can be formed at least in part as integral elements of the front and rear housing members 122, 124) can be substituted for the latch 150, as will be understood by those who are skilled in the art.

When the housing 120 is in the closed position shown in FIGS. 1-8, the components 162, 164 cooperate with the front and rear housing components 122, 124 to form the ergonomically shaped handle 160. As can best be seen in FIG. 17, the bulbous cross-section of the handle 160 can form an oval shape, which enables the rotary cutting device 100 to be very comfortably grasped to depress the steel cutting blade 110 into thin food such as the pizza 500 shown in FIG. 20, and to guide the steel cutting blade 110 along a desired path of travel 502 where thin food such as the pizza 500 is to be severed.

Figure 21:
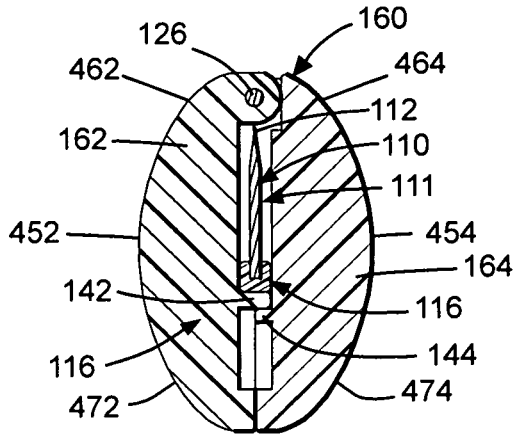
FIGS. 21-24 are cross-sectional views similar to FIG. 17 showing alternate forms of bulbous handle cross-sections; and, FIG. 25 is a perspective view similar to FIG. 20 showing the rotary cutting device being grasped and used to slice a pizza, with the cutting device oriented in what may be referred to as a "handle high" position.
Figure 22:
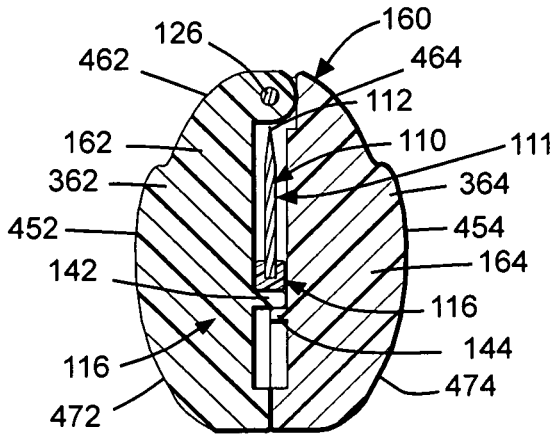
Figure 23:
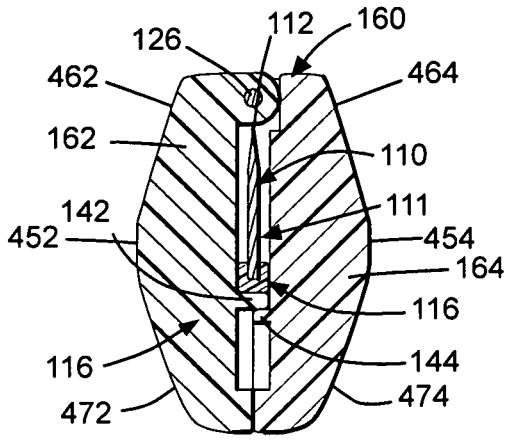
Figure 24:
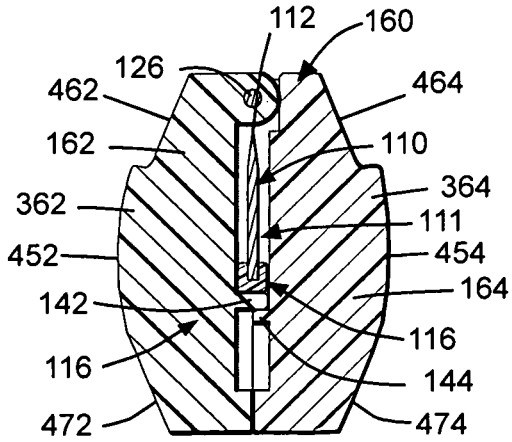

Alternative bulbous cross-sections of the handle 160 are illustrated in FIGS. 21-24. In the embodiment of FIG. 21, portions of the bulbous shape of the handle 160 are defined exclusively by the front and rear components 162, 164 of the handle 160, which cooperate to give the handle 160 an oval cross-section. In the embodiment of FIG. 22, the front and rear components 162, 164 of the handle 160 have outwardly bulging portions 362, 364 that also may contribute to the ergonomic graspability of the handle 160. In the embodiments of FIGS. 23 and 24, the front and rear components 162, 164 take other forms that bulge outwardly to contribute to the ergonomic graspability of the handles 160.

In each of the embodiments of FIGS. 17 and 21-24, the exterior surfaces of the resulting handles 160 are of ergonomically configured bulbous shape to be easily and comfortably grasped by a hand of a user, for example in the manner depicted in FIG. 20, as has just been explained, for utilizing the rotary cutting device 100 to slice thin foods such as the pizza 500 shown in FIG. 20. Moreover, the bulbous shaped cross-sections of the handles 160 shown in FIGS. 17 and 21-24 are equally comfortably grasped both by left and right-handed users.

In each of the embodiments of FIGS. 17 and 21-24, it is intended that the handle 160 has substantially the same length, that the handle 160 extend along a substantially straight-line portion of the border of the D-shaped opening 109, and that the handle 160 enclose an angular reach of the cutting blade assembly 111 of at least about one hundred fifty degrees, to enclose about a one hundred fifty two degree reach of the sharpened cutting edge 112 of the cutting blade 110, as shown in FIG. 16.

Referring to FIGS. 1, 2, 4 and 8, thumb guards 166, 168 preferably are provided near opposite end regions of the handle 160 (i.e., on the left and right sides of the exterior of the front and rear housing components 122, 124), and are configured to reduce hand fatigue and to maximize user control of the rotary cutting device 100. The thumb guards 166, 168 also serve to keep the user's thumb from extending downwardly alongside opposite end regions of the handle 160 where the user's thumb might inadvertently come into engagement with the sharpened edge 112 of the steel cutting blade 110.

Referring to FIGS. 1-8 and to FIG. 16, when the housing components 122, 124 are in the closed position, a significant upper part of the steel cutting blade 110 is protectively enclosed by the upper portions of the front and rear housing components 122, 124. The graspable handle 160 extends for an angular range that, as can be seen in FIG. 16, extends for at least about ninety degrees. When a reach of the sharpened cutting edge 112 extending for at least an angular range of one hundred fifty degrees (such as the one hundred fifty two degree reach shown in FIG. 16) is protectively enclosed by the housing 120, this enclosure leaves slightly more than two hundred degrees of the sharpened cutting edge 112 of the cutting blade 110 exposed for use in cutting thin food such as pizza, which permits the rotary cutting device 100 to be tilted in a manner shown in FIG. 20 so the device 100 can be grasped and easily pushed and pulled along desired travel paths (such as the depicted travel path 502) to sever thin food such as the depicted pizza 500 into pieces of desired configuration and size.

Where the annular cutting edge 112 of the blade 110 enters and exits the housing 120, the front and rear components 122, 124 cooperate to provide openings that closely receive the annular cutting blade 110 to prevent food from entering into and accumulating within the interior of the housing 120.

In use, a cutting action is initiated by the user applying downward pressure and forward motion to the handle 160 to cause the annular cutting blade 110 to rotate within the housing 120 to cut food (such as the pizza 500 shown in FIGS. 20 and 25) situated beneath the annular cutting blade 110. As the rotary cutting device 100 is moved across the food along a travel path such as that indicated by the numeral 502 in FIGS. 20 and 25, the annular cutting blade 110 is guided to follow paths of travel where cuts are to be made. The exposed portion of the cutting edge 112 of the annular cutting blade 110 that is not enclosed by the housing 120 turns as the blade 110 engages and severs the food that is being cut; and the relatively large outer diameter of the steel cutting blade 110 allows for a smooth and stable cutting action, while the centrally located position of the handle 160 creates a comfortable and controlled experience for the user.

When the cutting task is complete, the housing 120 of the rotary cutting device 100 can be easily opened by disengaging the hook shaped component 154 from the surface 152 of the built-in latch 150, to permit the housing 120 to open to provide access to the removable cutting blade 110 so interior and exterior surfaces of the various components of the rotary cutting device 100 can be accessed and cleaned.

A feature of hand held rotary cutters of the type depicted in the drawings hereof is the provision of the C-shaped front and rear lower portions 182, 184 of the front and rear housing components 122, 124, respectively, that extend along and protectively enclose opposite sides of inner diameter portions of the steel cutting blade 110 to ensure that the cutting blade 110 does not deflect from its intended planar (flat) configuration, and to provide guidance in very close proximity to the precise portion of the blade 110 that engages thin food such as the pizza 500 that is being cut. Regardless of whether the cutting device is oriented in a "handle high" attitude as depicted in FIG. 25, or in a "handle low" or tilted attitude as depicted in FIG. 20, the C-shaped front and rear lower portions 182, 184 of the front and rear housing components 122, 124, respectively closely overlie, engage and provide close-at-hand guidance to the exact portion of the steel cutting blade 110 that is being used to sever the pizza 500—which is a type of housing engagement and guidance that is not offered by previously proposed rotary cutters found in the prior art.

Moreover, because the curved formations 142, 144 (see FIGS. 9-11) of the front and rear housing components 122, 124 engage the blade guard 116 at locations inside the front and rear lower portions 182, 184 just above where the steel cutting blade 110 engages and severs thin food being cut, such as the pizza 500, the housing 120 applies downward pressure to the steel cutting blade 110 just above where the blade 110 applies cutting force to the food being cut, and this close-at-hand application of force to the cutting area of the blade 110 ensures that the blade 110 properly severs the food being cut while turning smoothly about its virtual axis 50 shown in FIG. 16. No other known prior art rotary cutter is designed to apply cutting force to an annular cutting blade at a location so close to where cutting action is taking place, and to also provide guidance to an annular cutting blade near the location of the cutting action to ensure that the annular blade is prevented from bending or deviating from its intended travel path 502.

The housing 120 of the cutting device 100 and the blade guard 116 that extends along the inner diameter of the cutting blade 110 are preferably formed principally from heat resistant plastics materials such as polypropylene that provide smooth surfaces that offer low coefficients of friction to the rotary cutting blade 110—but can, of course, alternatively be formed from other materials such as stainless steel. The front and rear components 192, 194 of the housing 120 may be formed from softer material than is used to form the front and rear components 122, 124, such as heat resistant rubber. The hinge pin 126 and the cutting blade 110 are preferably formed from corrosion resistant metal such as stainless steel; however, other durable materials presently known and yet to be discovered that are suitable to form cutting blades may also be selected to form the cutting blade 110. The selection of materials to form various components of the rotary cutter 100 is a matter preferably left to those who are skilled in the art, who will appreciate that a variety of materials can be considered for these purposes without departing from the spirit and scope of the present invention.

Although the front and rear housing components 122, 124 are depicted as each being of one-piece construction as though injection molded, these and other component parts of the rotary cutter 100 may be formed from plural components manufactured in different ways and from different materials selected to provide good performance of their intended functions, as will be readily understood by those who are skilled in the art.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended to protect whatever features of patentable novelty exist in the invention disclosed.

What is claimed is:

1. A hand held rotary cutting device comprising a housing and an annular cutting blade having an internal diameter entirely protectively enclosed by the housing, and having a sharpened periphery that is only partially protectively enclosed by the housing leaving a C-shaped reach of the sharpened periphery exposed for engaging and severing foods, wherein the housing 1) includes front and rear components that are movable between a closed position wherein the housing rotatably supports the cutting blade and an open position that permits removal of the cutting blade for cleaning, and 2) includes a releasable retainer to retain the front and rear components in the closed position, with the front and rear components cooperating, when in the closed position, to provide C-shaped lower portions that extend along opposite sides of the internal diameter of a portion of the cutting blade that defines the C-shaped reach of the sharpened periphery of the cutting blade that is exposed to engage and sever thin foods, the C-shaped reach of the sharpened periphery that is exposed forming a majority of the sharpened periphery.

2. The rotary cutting device of claim 1 wherein the front and rear components cooperate, when in the closed position, to define an elongate handle of bulbous shaped cross-section that overlies and protectively encloses front and rear surfaces of a selected angular reach of the sharpened periphery of the cutting blade.

3. The rotary cutting device of claim 2 wherein the elongate handle of bulbous shaped cross-section extends along at least about a 90 degree angular reach of the cutting blade.

4. The rotary cutting device of claim 2 wherein the bulbous shaped cross-section is of maximum area at a midway location along the length of the elongate handle, and an area of the bulbous cross-section diminishes at locations along the length of the elongate handle spaced progressively farther from the midway location.

5. The rotary cutting device of claim 4 wherein the bulbous shaped cross-section is a substantially oval shaped cross-section that maintains substantially the same oval shape as the cross-section diminishes in area at the locations along the length of the elongate handle spaced progressively farther from the midway location.

6. The rotary cutting device of claim 4 wherein the front and rear portions of the housing cooperate to define thumb guards located along a periphery of the housing at locations near opposite end regions of the elongate handle.

7. The rotary cutting device of claim 1 wherein the internal diameter of the annular cutting blade surrounds an open central region of the annular cutting blade, and wherein the front and rear housing components cooperate, when in the closed position, to define a substantially D-shaped central opening situated inside the open central region of the annular cutting blade, wherein the elongate handle extends along a substantially straight portion of a border of the D-shaped opening.

8. The rotary cutting device of claim 7 wherein the D-shaped opening occupies a majority of the open central region of the annular cutting blade, and wherein the D-shaped opening enables a portion of a hand to pass therethrough while grasping the handle.

9. The rotary cutting device of claim 8 wherein the releasable retainer is a latch that includes a portion which extends through the open central region of the annular cutting blade at a location along the border of the D-shaped opening opposite the handle.

10. The rotary cutting device of claim 7 wherein the interior diameter of the cutting blade is protectively enclosed by a blade guard of generally U-shaped cross-section that extends without interruption along the interior diameter, and the housing provides at least one curved formation extending along a length of the blade guard to guide and apply downwardly directed force to the cutting blade during rotation of the cutting blade relative to the housing.

11. The rotary cutting device of claim 10 wherein the at least one curved formation includes at least a pair of curved formations that extend along different portions of the length of the blade guard to guide the cutting blade during its rotation relative to the housing.

12. The rotary cutting device of claim 1 wherein, when the housing is closed, the front and rear components of the housing cooperate to protectively enclose front and rear surfaces of an angular reach of at least about 150 degrees of the sharpened periphery of the cutting blade, leaving the exposed reach of at least about 200 degrees of the sharpened periphery of the cutting blade available to engage and sever food.

13. A rotary cutting device having a housing and an annular cutting blade with an internal diameter that surrounds an open central region of the annular cutting blade and with a sharpened periphery partially protectively enclosed by the housing having similarly configured, pivotally connected, front and rear components movable between open and closed positions that cooperate when in the closed position to rotatably support the cutting blade, to entirely enclose the internal diameter and to define an elongate handle of bulbous shaped cross-section overlying a fully housed angular reach of the cutting blade enabling a portion of a hand to reach through the open central region while grasping the elongate handle, and wherein a latch is adapted to releasable retain the front and rear components in the closed position.

14. The rotary cutting device of claim 13 wherein the front and rear components cooperate, when in the closed position, to provide C-shaped lower portions that extend along opposite side locations of the internal diameter of a portion of the cutting blade to entirely enclose the internal diameter, the cutting blade comprises a C-shaped reach of the sharpened periphery of the cutting blade that is exposed to sever food, the C-shaped lower portions provided by the front and rear components engage, guide and provide stability to the cutting blade by engaging the blade at the opposite side locations along the internal diameter of the portion.

15. The rotary cutting device of claim 13 wherein the bulbous shaped cross-section is of maximum area at a midway location along a length of the elongate handle, and an area of the bulbous cross-section diminishes at locations along the length of the elongate handle spaced progressively farther from the midway location.

16. The rotary cutting device of claim 13 wherein the bulbous shaped cross-section is a substantially oval shaped cross-section that maintains substantially the same oval shape as the cross-section diminishes in area at locations along a length of the elongate handle spaced progressively farther from a midway location.

17. The rotary cutting device of claim 16 wherein the front and rear portions of the housing cooperate to define thumb guards located along peripheral portions of the housing near opposite end regions of the elongate handle of bulbous shaped cross-section.

18. The rotary cutting device of claim 13 wherein the front and rear components of the housing cooperate when in the closed position to fully enclose at least about 150 degrees of the angular reach of the cutting blade, leaving an exposed reach of at least about 200 degrees of the sharpened periphery of the cutting blade available to engage and sever food.

19. The rotary cutting device of claim 13 wherein the front and rear housing components cooperate, when in the closed position, to define a substantially D-shaped central opening situated inside the internal diameter of the annular cutting blade, and wherein the elongate handle extends along a substantially straight portion of a border of the D-shaped opening.

20. The rotary cutting device of claim 19 wherein the D-shaped opening occupies a majority of an area circumscribed by the internal diameter of the annular cutting blade.

21. The rotary cutting device of claim 20 wherein the latch includes a portion that extends through the area circumscribed by the internal diameter of the cutting blade at a location along the border of the D-shaped opening opposite the handle.

22. The rotary cutting device of claim 20 wherein the latch has a component carried by one of the front and rear components configured to releasable engage a surface defined by the other of the front and rear housing components at a location inside the area circumscribed by the internal diameter of the annular cutting blade to releasable retain the front and rear components in the closed position.

23. The rotary cutting device of claim 19 wherein the annular cutting blade has a region extending along the internal diameter that is protectively enclosed by a blade guard of generally U-shaped cross-section that extends without interruption along the internal diameter, and the housing provides at least one curved formation configured to extend along and to engage a portion of the blade guard to guide the cutting blade during rotation of the cutting blade relative to the housing.

24. The rotary cutting device of claim 23 wherein the at least one curved formation includes at least a pair of curved formations that each extend along different portions of the length of the blade guard to guide the cutting blade as the cutting blade turns relative to the housing.

25. The rotary cutting device of claim 13 wherein the elongate handle of bulbous cross-section extends along at least about 90 degrees of the angular reach of the annular cutting blade.

26. A hand held rotary cutting device having an annular cutting blade that protectively overlies a full length of an internal diameter of the annular cutting blade having an open central region defined by the internal diameter and having a sharpened periphery that is protectively shielded along at least about a 150 degree reach of the cutting blade by front and rear portions of the housing that are pivotally connected to move between an open position that permits the annular cutting blade to be removed for cleaning, and a closed position wherein the front and rear portions of the housing cooperate to define an elongate handle of bulbous shaped cross-section that overlies a majority of the shielded reach of the sharpened periphery of the cutting blade that is able to be grasped by a portion of a hand extending through the open central region, with one of the front and rear portions carrying a latch adapted to releasable retain the front and rear portions of the housing in the closed position.

27. A hand held rotary cutting device comprising an annular shaped cutting blade and a housing having substantially identically shaped, pivotally connected, front and rear components each having C-shaped lower portions and being movable between an open position that permits removal from the housing of the annular shaped cutting blade, and a closed position wherein the front and rear components cooperate 1) to rotatably support the annular shaped cutting blade, 2) to protectively shield an entire portion of the annular cutting blade that extends along an internal diameter of the cutting blade via the C-shaped lower portions, and 3) to protectively shield at least about a 150 degree reach of a sharpened periphery of the annular cutting blade leaving an exposed C-shaped reach of at least about 200 degrees of the sharpened periphery of the annular cutting blade for engaging and severing food.

28. The rotary cutting device of claim 27 wherein the front and rear housing components also cooperate, when in the closed position, to define an elongate handle of substantially oval shaped cross-section that extends along a majority of a length of the portion of the housing that shields the 150 degree reach of the sharpened periphery of the annular cutting blade.

29. The rotary cutting device of claim 28 wherein the oval shaped cross-section is of maximum area at a midway location along a length of the elongate handle, and an area of the oval shaped cross-section diminishes at locations along the length of the elongate handle spaced progressively farther from the midway location.

30. The rotary cutting device of claim 29 wherein, when the front and rear housing components are in the closed position, they also cooperate to define a substantially D-shaped central opening situated inside the internal diameter of the annular cutting blade, and the elongate handle extends along a substantially straight portion of a border of the D-shaped opening enabling a portion of a hand to reach through the D-shaped opening while grasping the elongate handle.

31. The rotary cutting device of claim 30 wherein the D-shaped opening occupies a majority of an area circumscribed by the internal diameter of the annular cutting blade.

32. The rotary cutting device of claim 29 wherein, when the front and rear housing components are in the closed position, one of the front and rear components includes a releasable latch-inlay to retain the front and rear housing components in the closed position.

33. A hand held rotary cutting device comprising:

an annular blade having an inner diameter surrounding an open central region and a sharpened periphery; and a housing that rotatably supports the annular blade, entirely encloses the inner diameter of the blade, and enables a portion of a hand to extend through the open central region, the housing comprising:

a handle portion protectively enclosing the inner diameter and the sharpened periphery of a first angular reach of the annular blade; and a C-shaped portion extending from the handle and enclosing the inner diameter of a second angular reach of the annular blade, the second angular reach comprising a greater portion of the annular blade than the first angular reach.

34. The rotary cutting device of claim 33 wherein the second angular reach comprises at least a 200 degree reach of the sharpened periphery.

35. The rotary cutting device of claim 33 wherein:

the handle comprises a first thumb guard at the first end of the elongate handle;

the handle comprises a second thumb guard at a second end of the elongate handle.

36. The rotary cutting device of claim 33 wherein a diameter of the sharpened periphery is about 5.25 inches and the inner diameter is about 3.75 inches.

* * * * *